US005098266A

United States Patent [19]

Takimoto et al.

[11] Patent Number: 5,098,266

[45] Date of Patent: Mar. 24, 1992

[54] LUBRICATION OF A HORIZONTAL ROTARY COMPRESSOR

[75] Inventors: Naoshi Takimoto; Yutaka Sato; Hirokazu Kohayakawa; Sou Suzuki; Masaji Hagiwara; Kenji Suzuki; Yoshinori Shirafuji, all of Shizuoka, Japan

[73] Assignee: Mitsubishi Denki Kabushiki Kaisha, Tokyo, Japan

[21] Appl. No.: 578,289

[22] Filed: Sep. 6, 1990

[30] Foreign Application Priority Data

Sep. 8, 1989 [JP] Japan ..... 1-233740
Oct. 26, 1989 [JP] Japan ..... 1-278961

[51] Int. Cl.[5] ..... F04C 18/356; F04C 29/02

[52] U.S. Cl. ..... 418/63; 418/63; 418/88; 418/94; 418/96

[58] Field of Search ..... 418/63, 88, 91, 94, 418/96; 184/6.16

[56] References Cited

U.S. PATENT DOCUMENTS

| | | | |
|---|---|---|---|
| 4,385,875 | 5/1983 | Kanazawa | 418/88 |
| 4,472,121 | 9/1984 | Tanaka et al. | 418/91 |
| 4,544,338 | 10/1985 | Takebayashi | 418/88 |
| 4,624,630 | 11/1986 | Hirahara et al. | 418/94 |
| 4,704,076 | 11/1989 | Kawaguchi et al. | 418/91 |
| 4,850,830 | 7/1989 | Okoma | 418/94 |

FOREIGN PATENT DOCUMENTS

| | | | |
|---|---|---|---|
| 158988 | 3/1956 | Japan . | |
| 158992 | 3/1956 | Japan . | |
| 53-153518 | 12/1978 | Japan | 418/94 |
| 58-23993 | 5/1983 | Japan . | |
| 2-264189 | 10/1990 | Japan . | |

*Primary Examiner*—Richard A. Bertsch
*Assistant Examiner*—David L. Cavanaugh
*Attorney, Agent, or Firm*—Oblon, Spivak, McClelland, Maier & Neustadt

[57] ABSTRACT

A horizontal rotary compressor comprises a sealed shell having a lubricating oil accumulated at a lower part therein; a drive unit included in the sealed shell; a compression unit included in the sealed shell and driven by the drive unit through a crankshaft; the crankshaft having a lubricating oil feeding hole formed therein; a lubricating oil pump for supplying the lubricating oil to the crankshaft to lubricate the compression unit; a discharge muffler which is arranged at the end of the compression unit remote from the drive unit, and which is provided with a lubricating oil passage; the lubricating oil passage having one end opened in the lubricating oil and the other end opened at the lubricating oil feeding hole; and a discharge refrigerant gas passage which is formed to be upwardly inclined in the discharge muffler so as to communicate from the space in the discharge muffler to the lubricating oil feeding passage.

4 Claims, 9 Drawing Sheets

LUBRICATION OF A HORIZONTAL ROTARY COMPRESSOR

BACKGROUND OF THE INVENTION

1. Field of the Invention

The present invention relates to a horizontal rotary compressor which can be utilized for refrigeration and airconditioning.

2. Discussion of Background

FIG. 20 is an axial sectional view showing the horizontal rotary compressor which is described in Japanese Patent Application No. 85308/1989 and has not been laid open to the public. FIG. 21 is a sectional view taken along the line XXI—XXI of FIG. 20 to show the structure of a lubricating oil pump. Besides the lubricating oil pump shown in FIG. 21, there is for example the lubricating oil pump which has been disclosed in Japanese Examined Utility Model Publication No. 23993/1983 and is shown in FIG. 22.

In FIG. 20, reference numeral 1 designates a sealed shell which houses a compression unit 2 and an electric drive unit 3 side by side in the substantially horizontal (transverse) direction, and in the bottom of which a lubricating oil 4 is accumulated. The compression unit 2 comprises a cylinder 5, a piston 6 which eccentrically rotates in the cylinder 5, a crankshaft 7 which drives the piston 6, a frame 9 having a main bearing 8, a head 11 having an end bearing 10, a vane 12 which functions to divide the inside of the cylinder 5 into a high pressure chamber and a low pressure chamber, and which reciprocates in contact with the piston 6, a lubricating oil pump 13 which provides the crankshaft 7 with the lubricating oil 4 in the bottom of the sealed shell 1 to lubricate sliding parts in the compression unit 2, and a frame side discharge muffler 14 and a head side discharge muffler 15 which are mounted on the frame 9 and the head 11, respectively. The main bearing 8 and the end bearing 10 are used to support the crankshaft 7 and to close both end surfaces of the cylinder 5. The frame side discharge muffler 14 and the head side discharge muffler 15 are provided with projections 16 and 17 which are used to direct a compressed refrigerant gas to locations approximate to the wall of the sealed shell 1, the projections 16 and 17 being made of shut metal parts or tubular parts.

The electric drive unit 3 comprises a stator 18 and an armature 19, at least one of which has passages 20 for passing the refrigerant gas. The compression unit 2 and the electric drive unit 3 are housed so as to be next to each other in the sealed shell 1. In the sealed shell 1, there are formed three spaces, i.e. an A space (electric motor space) defined by the sealed shell 1, the stator 18 and the armature 19, a B space defined by the electric drive unit 3 and the compression unit 2, and a C space (pump space) defined by the compression unit 2 and the sealed shell 1. The projections 16 and 17 communicate with the A space through a bypass pipe 21 which is arranged outside the sealed shell. The C space is provided with a discharge pipe 22 which is used to cause the refrigerant gas to flow out of the sealed shell. As a result, the compressor of FIG. 20 has a refrigerant passage which starts at the discharge mufflers 14 and 15 and ends at the discharge pipe 22 through the bypass pipe 21, the A space, the passages 20 of the electric drive unit, the B space and the C space.

As stated earlier, there are the lubricating oil pumps 13 for horizontal rotary compressors as shown in FIGS. 21 and 22. FIG. 21 is the sectional view taken along the line XXI—XXI of FIG. 20. In FIG. 21, reference numeral 23 designates a lubricating oil feeding tube. Reference numeral 24 designates a refrigerant tube which is fixed to be inserted into the lubricating feeding tube 23. The lubricating oil feeding tube 23 has one end arranged in the lubricating oil 4, and the other end arranged in the substantially central portion of the discharge muffler 15 together with a cup 25 for leading the lubricating oil 4 to the crankshaft 7. The refrigerant tube 24 has one end inserted into the lubricating oil feeding tube 23, and has the other end communicated with the space in the discharge muffler 15.

The other lubricating oil pump that has been used is constituted as shown in FIG. 22. A muffler 26 which has a head and a discharge muffler in one piece is formed with a discharge hole 27 and a lubricating oil pump groove 28. In addition, a cover 29 is bolted to the discharge muffler. The lubricating oil pump is formed in that manner. Reference numeral 30 designates a discharge valve which is mounted at the discharge hole 27, and which can be opened and closed depending on the pressure of a refrigerant gas in a compression chamber 31.

In operation, the electric drive unit 3 is driven to rotate the crankshaft 7. The piston 6 eccentrically rotates in the compression chamber (not shown), and compresses the refrigerant gas with the vane 12 which is in contact with the outer peripheral surface of the piston 6 and is supported by the cylinder 5. The compressed refrigerant gas is discharged from discharge holes 32 and 33 which are formed in the frame 9 and in the head 11, respectively. The refrigerant gas thus discharged spreads in the discharge mufflers 14 and 15. The refrigerant gas which is in the discharge muffler 14 at the side of the frame 9 flows into the bypass pipe 21 through the projection 16, and reaches the A space. On the other hand, the refrigerant gas which has discharged in the discharge muffler 15 at the side of the head 11 partly flows through the refrigerant tube 24 of the lubricating oil pump 13. The lubricating oil is supplied to crankshaft 7 from an oil intake port 34 of the lubricating oil feeding tube 23 by the use of the energy of the refrigerant gas which is flowing at a high speed. The remaining refrigerant gas which does not work for feeding the lubricating oil flows into the bypass pipe 21 through the space in the projection 17 which is mounted to the discharge muffler 15 at the side of the head 11. Then the refrigerant gas passes through the bypass pipe 21, and reaches the A space. The refrigerant gas which has reached the A space arrives at the B space through the passages 20 which are arranged in at least one of the stator 18 and the armature 19. The refrigerant gas passes through a through hole 35 in the cylinder 5 and reaches the C space. After that, it flows out of the sealed shell 1 through the discharge pipe 22 which is arranged in the C space.

In FIG. 20, arrows indicate the flow of the refrigerant gas. In FIG. 21 wherein there is shown the lubricating oil pump for compressors, arrows (←) in black indicate the flow of the compressed refrigerant gas. Arrows (⇐) in white indicate the flow of the lubricating oil. The arrows in black and white indicate the oil feeding operation by the lubricating oil pump.

The flows of the refrigerant gas and the lubricating oil in the lubricating oil pump of FIG. 22 are like those of the oil pump of FIG. 21. The refrigerant gas which has discharged from the discharge hole 27 flows in the oil pump groove 28. When the refrigerant gas passes by an oil intake groove 36 which is arranged below the surface of the lubricating oil (not shown), the refrigerant gas draws the lubricating oil from the oil intake groove 36, and carries the lubricating oil to an opening formed in the end of the crankshaft 7. The difference between the flows of the refrigerant of FIGS. 21 and 22 is follows: In the structure shown in FIG. 21, part of the compressed refrigerant gas is utilized as an oil pump. On the other hand, in the structure shown in FIG. 22, the discharge muffler 26, the head 11, end bearings (not shown), the oil pump groove 28, the oil intake groove 36 and the discharge hole 27 are formed as one piece part, and the compressed refrigerant gas is entirely used as an oil pump.

The horizontal rotary compressors having the structures as stated earlier have the following disadvantages:

(1) The projections 16 and 17 which are used to direct the compressed refrigerant gas, the oil pump lubricating oil feeding tube 23 and the oil pump refrigerant tube 24 are made of sheet metal parts or tubular parts, creating problems wherein the necessity of many parts requires a substantial cost, the difficulty in the production takes much time, and there is a strong possibility of getting defectives.

(2) The oil pump of FIG. 22 can decrease the number of required parts because the discharge muffler, the head the bearings, the discharge hole, the oil pump groove, the oil intake groove and the like are made as one piece part. However, in order to provide the one piece part with many functions, the number of the machining steps is increased to raise a cost. Because the refrigerant gas has to be entirely used for oil pumping function due to integral structure of the head and the discharge muffler, the proportion of the lubricating oil which is included in the refrigerant gas is increased to deteriorate the efficiency of the compressor and to raise the amount of the lubricating oil which is carried out of the sealed shell. In some operating conditions of the compressor, the refrigerant gas can flow in the oil pump groove 28 in amounts more than needed as an oil pump. As a result, there is a possibility that the refrigerant gas flows off out of the oil intake groove 36, and the oil pump loses its function due to impossibility in oil feeding.

SUMMARY OF THE INVENTION

It is an object of the present invention to dissolve the problems stated earlier, and to provide a new and improved horizontal rotary compressor capable of offering high reliability at a low cost and facilitating production without almost changing the strength of parts constituting the compression unit, machining steps and machining precision.

The foregoing and other objects of the present invention have been attained by providing a horizontal rotary compressor comprising a sealed shell having a lubricating oil accumulated at a lower part therein; a drive unit included in the sealed shell; a compression unit included in the sealed shell and driven by the drive unit through a crankshaft; the crankshaft having a lubricating oil feeding hole formed therein; a lubricating oil pump for supplying the lubricating oil to the crankshaft to lubricate the compression unit; a discharge muffler which is arranged at the end of the compression unit remote from the drive unit, and which is provided with a lubricating oil passage; the lubricating oil passage having one end opened in the lubricating oil and the other end opened at the lubricating oil feeding hole; and a discharge refrigerant gas passage which is formed to be upwardly inclined in the discharge muffler so as to communicate from the space in the discharge muffler to the lubricating oil feeding passage.

As a result, the present invention can facilitate the production of the lubricating oil pump which is constituted by the lubricating oil passage and the discharge refrigerant gas passage.

Preferably, the one end of the lubricating oil passage opens at at least one through passage which is formed in a cylinder at a location behind a vane which is arranged in a cylinder for compressing a refrigerant gas. This arrangement can improve lubricating oil feeding capability.

Preferably, the connection between the discharge refrigerant gas passage and the lubricating oil feeding passage is made below the lubricating oil surface. Such arrangement can further improve lubricating oil capability.

Preferably, the one end of the discharge muffler also opens in the lubricating oil, and the connection between the discharge refrigerant gas passage and the lubricating oil feeding passage is made below the lubricating oil surface. This arrangement can furthermore improve lubricating oil capability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
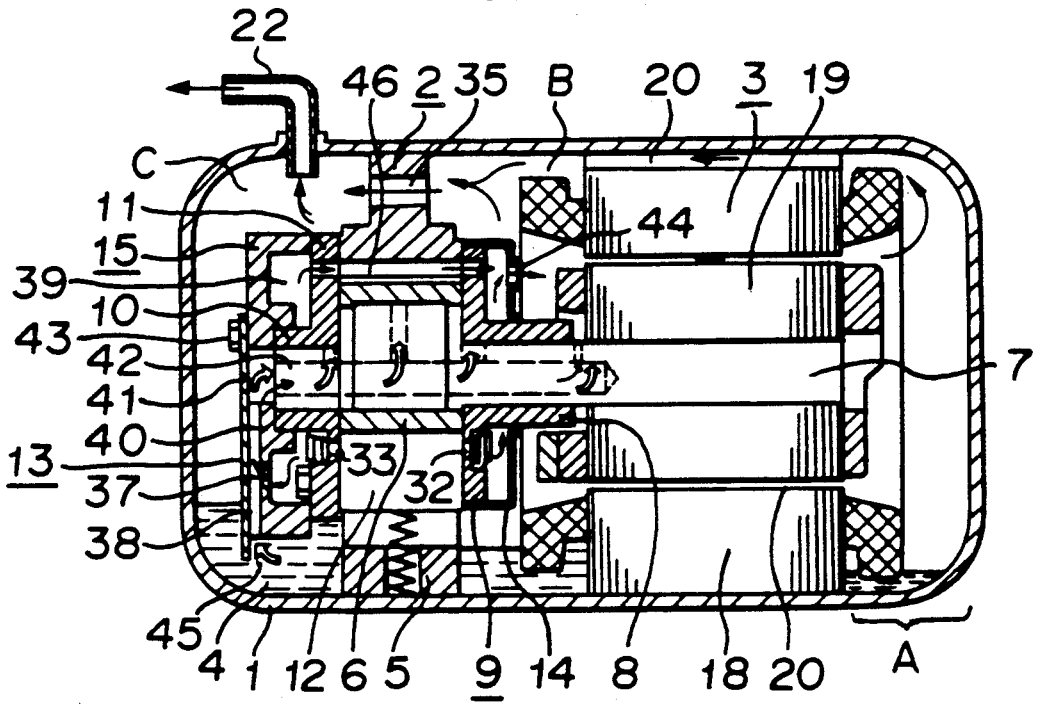
FIG. 1 is an axial sectional view showing a first embodiment of the horizontal rotary compressor according to the present invention.

Referring now to the drawings, wherein like reference numerals designate identical or corresponding parts throughout the several views, and more particularly to FIG. 1 thereof, there is shown an axial sectional view of a first embodiment of the horizontal rotary compressor according to the present invention. In FIG. 1, a sealed shell 1 includes a compression unit 2 and an electric drive unit 3. The sealed shell 1 accumulates a lubricating oil 4 at a lower part therein. The compression unit 2 is constituted by a cylinder 5, a piston 6 which eccentrically rotates in the cylinder 5, a crankshaft 7 which drives the piston 6, a frame 9 having a main bearing 8 for the crankshaft 7, a head 11 having an end bearing 10 for the crankshaft 7, a vane 12 which is arranged in the cylinder 5 as usual, a frame side discharge muffler 14 which is mounted to the frame 9, a head side discharge muffler 15 which is mounted to the head 11 and which can work as a lubricating oil pump 13, and discharge holes 32 and 33 which are formed in the frame 9 and the head 11, respectively. The electric drive unit 3 is constituted by a stator 18 and an armature 19. The lubricating oil pump 13 is constituted by a refrigerant passage 37 and a lubricating oil feeding passage 38. The refrigerant passage 37 is formed to be upwardly inclined in the discharge muffler 15 toward the lubricating oil passage 38, and connects between the lubricating oil passage 38 and the space 39 in the discharge muffler 15. The lubricating oil passage 38 is formed by providing the discharge muffler 15 with a recessed portion 40 and putting a cover 41 on the discharge muffler 15. The lubricating oil passage 38 has one end opened in the lubricating oil 4 which is stored in the sealed shell 1. The lubricating oil passage 38 has the other end opened to a lubricating oil feeding hole 42 which is formed in the crankshaft 7. Bolts 43 are screwed into the discharge muffler 15 to fix the cover 41 thereto. The discharge muffler 15 has the refrigerant passage 37 formed therein to be upwardly inclined and the cover bolted thereto as shown in FIG. 1. In consideration of these, parts which are prepared by mold forming such as sintering and casting can be used for fabrication of the lubricating oil pump to minimize the number of required parts. Reference numeral 44 designates a hole which is formed in the frame side discharge muffler 14, and which communicates between the space in the discharge muffler 14 and a space (B space) defined by the compression unit and the electric drive unit 3. Reference numeral 35 designates a through hole which is formed in the cylinder 5, and which communicates between the space (B space) defined by the compression unit 2 and the electric drive unit 3 and a space (C space) defined by the compression unit 2 and the sealed shell 1.

Figure 2:
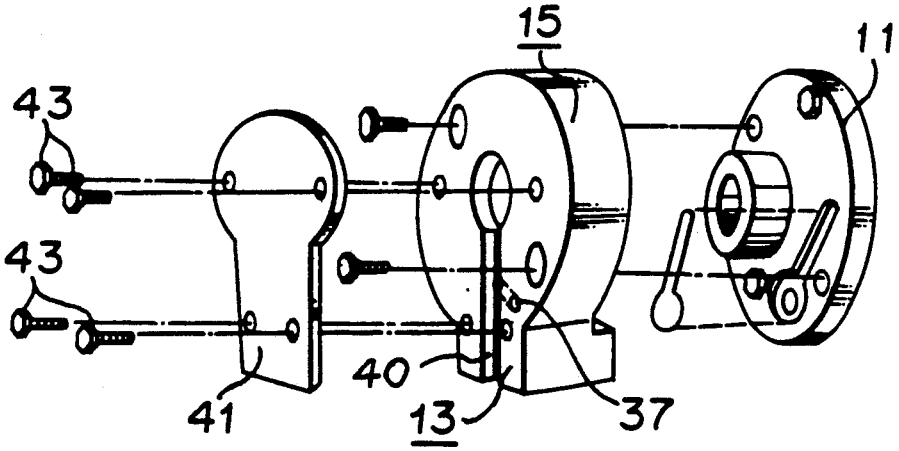
FIG. 2 is a perspective view showing a lubricating oil pump in a disassembled manner, the lubricating oil pump being incorporated in the horizontal rotary compressor of FIG. 1.
Figure 3:
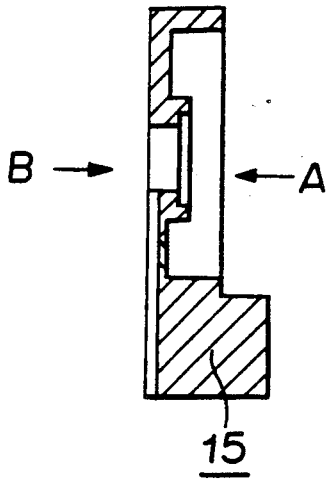
FIG. 3 is a cross sectional view showing a discharge muffler which is a part of the lubricating oil pump of FIG. 2.
Figure 4:
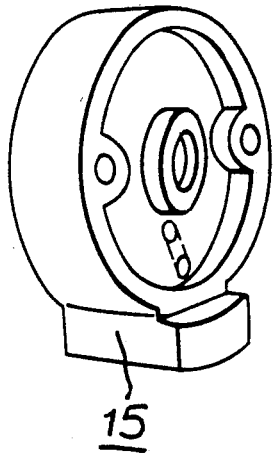
FIGS. 4 and 5 are perspective views seen from the direction of A and from the direction of B in FIG. 3, respectively.
Figure 5:
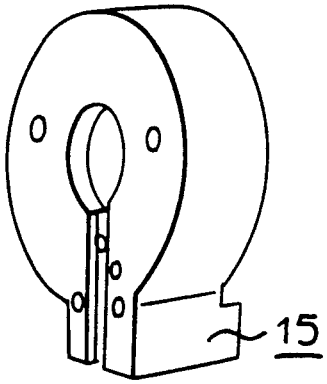

FIG. 2 is a perspective view showing the structure of the lubricating oil pump 13 of FIG. 1. In FIG. 2, the head side discharge muffler 15 is fastened to the head 11 with two bolts and the discharge muffler 15 has the cover 41 fastened thereto with four bolts 43. In order to utilize part of a refrigerant gas for lubricating oil pumping action, the discharge muffler 15 has the refrigerant passage 37 formed therein to be upwardly inclined therein. The recessed portion 40 formed in the discharge muffler 15 and the cover 41 put over the recessed portion 40 constitute the lubricating oil passage 38. FIG. 3 is an axial sectional view showing the discharge muffler 15 of the first embodiment. FIGS. 4 and 5 are perspective views of the discharge muffler 15 which are shown from the direction of A and from the direction of B in FIG. 3, respectively.

The operation of the horizontal rotary compressor according to the first embodiment will be explained. When the armature 19 of the electric drive unit 3 rotates, the crankshaft 7 turns to make the piston 6 eccentrically rotate in a compression chamber (not shown) of the cylinder. The piston 6 compresses the refrigerant gas with the vane 12 which is supported by the cylinder 5 and is in contact with the outer peripheral surface of the piston 6. The compressed refrigerant gas discharges from the discharge holes 32 and 33 which are formed in the frame 9 and the head 11, respectively. Then the compressed refrigerant gas spreads in the discharge muffler 14 and 15. Part of the refrigerant gas which has discharged from the discharge hole 33 at the side of the head flows through the refrigerant passage 37 upwardly and energetically, and reaches the end of the crankshaft 7 along the lubricating oil passage 38. Such energy of the refrigerant gas is utilized to suck the lubricating oil from an inlet 45 where the lubricating oil feeding passage 38 opens in the lubricating oil 4. The lubricating oil flows together with the refrigerant gas into the lubricating oil feeding hole 42 in the crankshaft 7 to supply the lubricating oil to sliding parts in the compression unit. The remaining refrigerant gas which has not worked for the lubricating oil feeding action after having spread in the head side discharge muffler 15 reaches the space in the frame side discharge muffler 14 through a through hole 46 which is formed in the cylinder 5, the frame 9 and the head 11. In the frame side discharge muffler 14, the refrigerant gas which has passed through the through hole 46 joins with the refrigerant gas which has discharged from the frame side discharge hole 32. After that, the refrigerant gas thus joined flows into the B space through the hole 44 which is formed in the discharge muffler 14.

The refrigerant gas which has reached the B space arrives through gaps 20 at an A space defined by the sealed shell 1, the stator 18 and the armature 19, the gaps 20 being formed between the stator 18 and the armature 19 and formed between the stator 18 and the sealed shell 1. Then the refrigerant gas returns to the B space again. The refrigerant gas which has returned to the B space reaches the C space via a through hole 35 which is formed in the cylinder 5. The refrigerant gas which has reached the C space discharges from the sealed shell 1 to outside through a discharge tube 22 which is mounted to the sealed shell 1. By the way, not all refrigerant gas which has discharged from the hole 44 in the frame side discharge muffler 14 flows through the gaps 20 in the electric drive unit 3. The refrigerant gas partly discharges from the discharge tube 22 of the C space through the hole 35 without going to the A space. In FIG. 1, the flow of the refrigerant gas is indicated by arrows (←) in black and the flow of the lubricating oil is indicated by arrows (⇐) in white.

The arrangement wherein the lubricating pump 13 has the refrigerant passage 37 opened at the lubricating oil passage 38 in an upwardly slanted manner allows the refrigerant gas to constantly flow in an upwardly slanted direction without flowing back no matter how much the flow rate of the refrigerant may be. This ensures that the lubricating oil 4 is sucked to be fed to the crankshaft 7.

Figure 6:
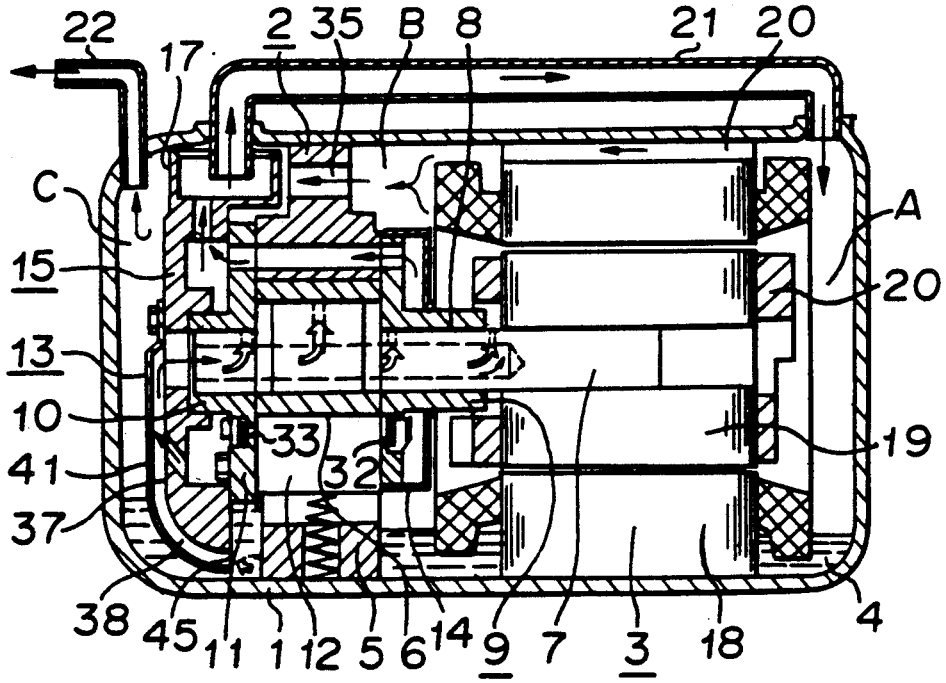
FIG. 6 is an axial sectional view showing a second embodiment of the horizontal rotary compressor according to the present invention.

A second embodiment of the present invention will be described. FIG. 6 is an axial sectional view showing the horizontal rotary compressor which the second embodiment is applied to. Parts which are identical or corresponding to those of FIG. 1 are indicated by the same reference numerals as those of FIG. 1. Reference numeral 17 designates a projection which is formed with a discharge muffler 15 as one piece unit. The refrigerant gas which has spread in the discharge muffler 15 is directed to the vicinity of the wall of a sealed shell 1 by the projection 17. A bypass pipe 21 is mounted to the sealed shell 1 so as to have one end projected into the projection 17 and the other end communicated with an A space which occupies a location next to an electric drive unit 3 and remote from a compression unit 2. As a result, the refrigerant gas flows into the A space through the bypass pipe 21. After that, the refrigerant gas reaches a B space through a gap 20 formed in a stator constituting an electric drive unit 3, and a gap 20 formed between the stator 18 and an armature 19. In this manner, the refrigerant gas can pass through the gaps 20 in the electric drive unit 3 to improve cooling effect to the electric drive unit 3 in comparison with the case of the first embodiment. The refrigerant gas which has entered the B space reaches a C space via a through hole 35 formed in a cylinder 5, the C space occupying a location next to the compression unit 2 and remote from the electric drive unit 3. The refrigerant gas which has entered the C space flows out of the sealed shell 1 through a discharge pipe 22 which opens in the C space.

Figure 7:
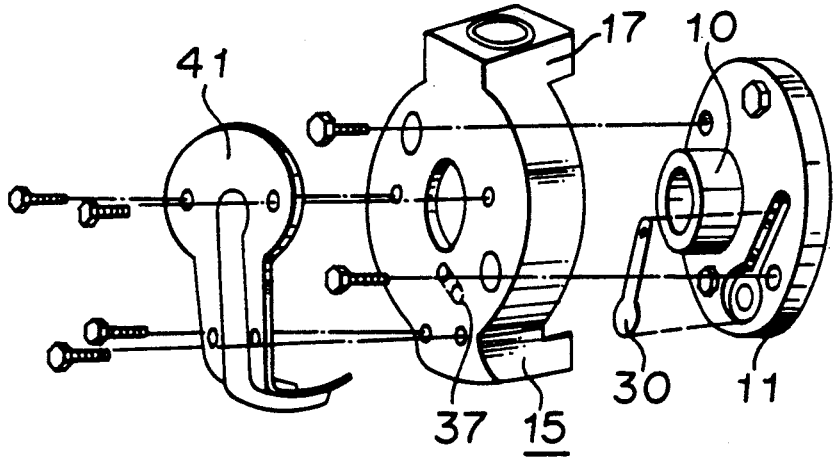
FIG. 7 is a perspective view showing a lubricating oil pump in a disassembled manner, the lubricating oil pump being incorporated in the horizontal rotary compressor of FIG. 6.
Figure 8:
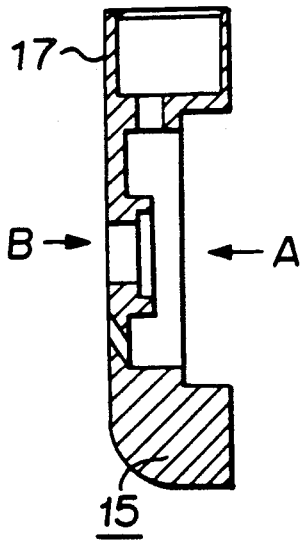
FIGS. 8 through 10 are views like FIGS. 3 through 5, showing a discharge muffler which is a part of the lubricating oil pump of FIG. 7.
Figure 9:
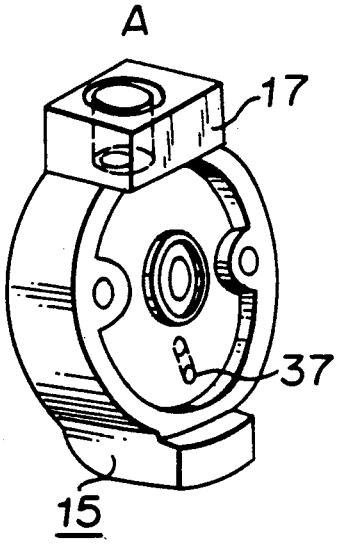
Figure 10:
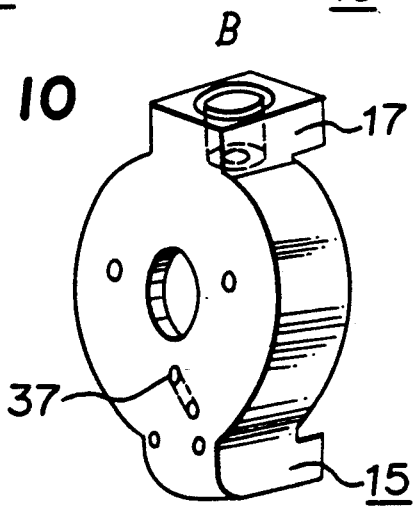

The arrangement wherein the bypass pipe 21 is provided outside the sealed shell 1 to forcibly direct the refrigerant gas to the A space and to forcibly pass it through the electric drive unit 3 is capable of improving cooling effect to the electric drive unit 3 by the refrigerant gas in comparison with the first embodiment, and preventing the electric drive unit 3 from being damaged due to an increase in temperature. When the projection 17 of the discharge muffler 15 which is required for such refrigerant passage system is formed as one piece unit with the discharge muffler 15 which can work as a lubricating oil pump 13, the number of required part can be decreased. Reference numeral 37 designates a refrigerant passage which is formed to be upwardly inclined in the discharge muffler 15, and which opens at a lubricating oil passage 38. The lubricating oil passage 38 can be formed by providing a cover 41 with a recessed portion, and bolting the cover 41 to the discharge muffler 15, thereby establishing a lubricating oil pump. In FIG. 6, arrows (←) in black indicates the flow of the refrigerant gas, and arrows ( ) in white indicates the flow of the lubricating oil 4. The structure of the lubricating pump of the second embodiment is shown in FIG. 7. The assemblage of the lubricating oil pump according to the second embodiment is similar to that of the lubricating oil pump according to the first embodiment shown in FIG. 2, and explanation of it is omitted. FIGS. 8 through 10 are views showing the discharge muffler 15 of the second embodiment.

Figure 11:
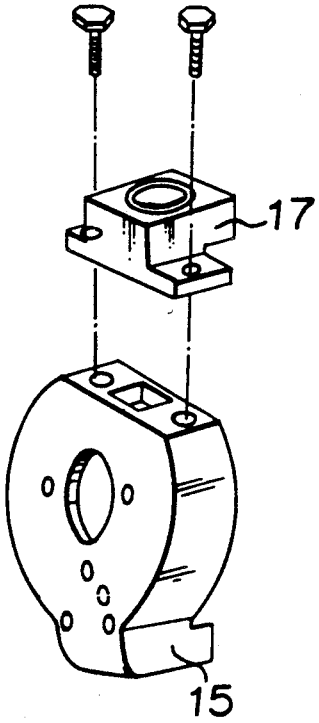
FIG. 11 is a perspective view showing the discharge muffler of a third embodiment in a disassembled manner.

Referring now to FIG. 11, there is shown a third embodiment. In the third embodiment, a projection 17 of a discharge muffler 15 is produced as a separate part in reference to the main body of the discharge muffler. The discharge muffler main body 15 and the projection 17 are fastened to each other by bolts to obtain a complete product as the discharge muffler with the projection. Such construction allows a mold required for sintering or casting to be produced at a low cost.

Figure 12:
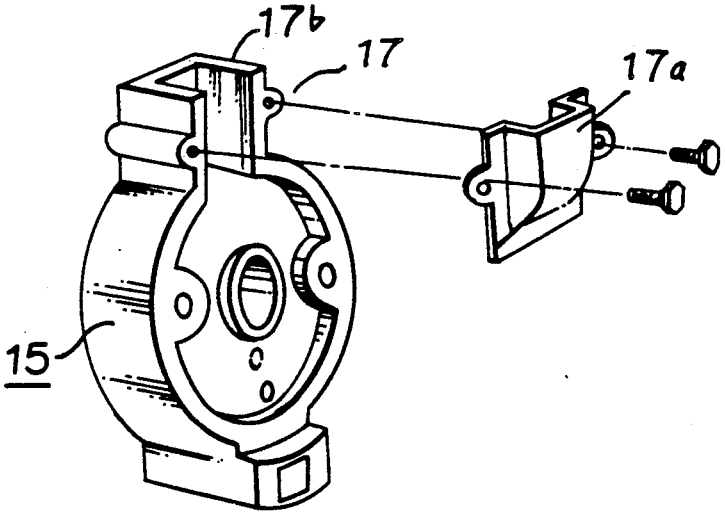
FIG. 12 is a perspective view showing the discharge muffler of a fourth embodiment in a disassembled manner.

Referring now to FIG. 12, there is shown a fourth embodiment of the present invention. In the fourth embodiment, the refrigerant passage of a projection 17 of a discharge muffler 15 is constructed by preparing the projection 17 with two piece parts, i.e. one half **17*a* and the other half 17*b*, and bolting the one half 17*a* to the other half 17*b*. The one half 17*a* is made of sheet metal, and the other half 17*b*** is made together with the discharge muffler main body by mold forming such as sintering and casting. The fourth embodiment also has the advantage of capable of producing molds at a low cost.

Figure 13:
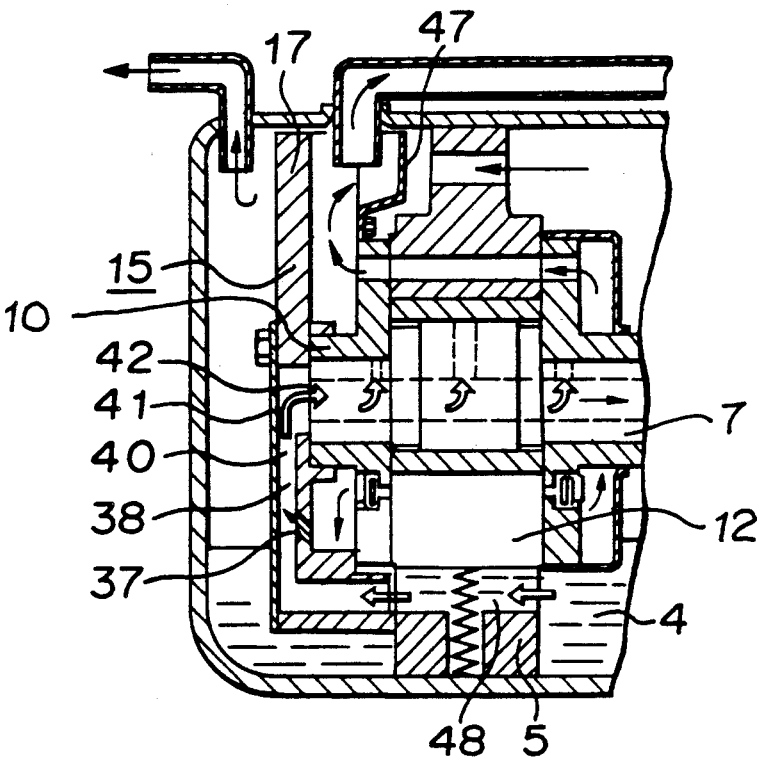
FIG. 13 is an axial sectional view in part of a fifth embodiment of the horizontal rotary compressor.
Figure 14:
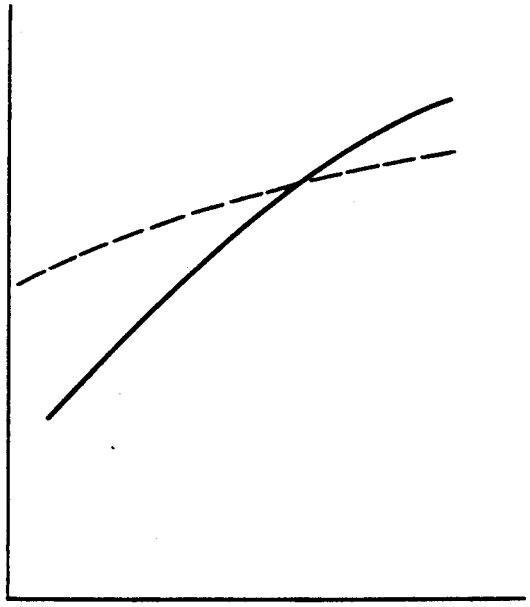
FIG. 14 is characteristic curves showing lubricating oil feeding amounts in the fifth embodiment.
Figure 15:
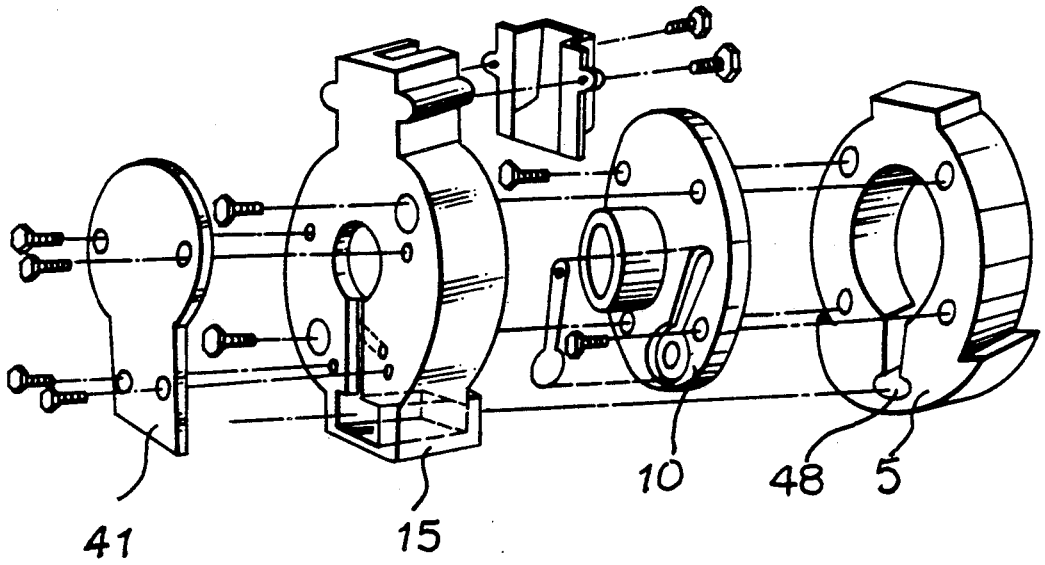
FIG. 15 is a perspective view showing a lubricating oil pump in a disassembled manner, the lubricating oil pump being incorporated in the fifth embodiment.

Referring now to FIG. 13, there is shown a fifth embodiment of the horizontal rotary compressor. FIG. 13 is a fragmentarily sectional view showing the essential parts of the fifth embodiment. A discharge muffler 15 of the fifth embodiment includes a projection 17 which has a sheet metal piece 47 attached thereto, a recessed portion 40, a refrigerant passage 37 heading in an upwardly slanted direction, and a cover 41. The cover 41 and the recessed portion 40 forms a lubricating oil passage 38. A cylinder 5 has a through passage 48 formed at a location behind a vane 12. The vane 12 which is supported by the cylinder 5 and reciprocates applies a pressure to the lubricating oil in the through passage 48. The opening end of the lubricating oil passage 38 which lies below the surface of the lubricating oil 4 opens to the through passage 48 behind the vane 12. The arrangement wherein the opening end of the lubricating oil passage 38 opens to face the through passage 48 behind the vane allows the feeding amount of the lubricating oil to be further increased, thereby offering a more reliable compressor. The reason why the feeding amount of the lubricating oil can be increased is that there are two effects; one is that the energy of the refrigerant gas is utilized to feed the lubricating oil, and the other is that the pressure which is caused behind the vane 12 by the reciprocation of the vane 12 in the lubricating oil in the through passage 48. The lubricating oil feeding amounts which are given to a lubricating oil feeding port 42 in a crankshaft 7 by utilizing these two oil feeding effects are shown as graphs in FIG. 14. In the graphs of FIG. 14, a solid line indicates the lubricating oil feeding effect by the refrigerant gas, and a dotted line indicates the lubricating oil feeding effect by the pressure behind the vane 12. The ordinate represents the oil feeding amounts (cc/sec) to the crankshaft 7, and the abscissa represents the revolution (rpm) of an electric drive unit 3 of the fifth embodiment. As shown in the graphs, the concurrence of these two oil feeding effects ensures that a required amount of the lubricating oil can be fed over a wide operation range of the compressor in comparison with the case wherein one of the two oil feeding effects is used to make oil feeding. In that manner, a highly reliable horizontal rotary compressor can be obtained. The assemblage of the lubricating oil pump 13 of the fifth embodiment is shown in FIG. 15.

Figure 16:
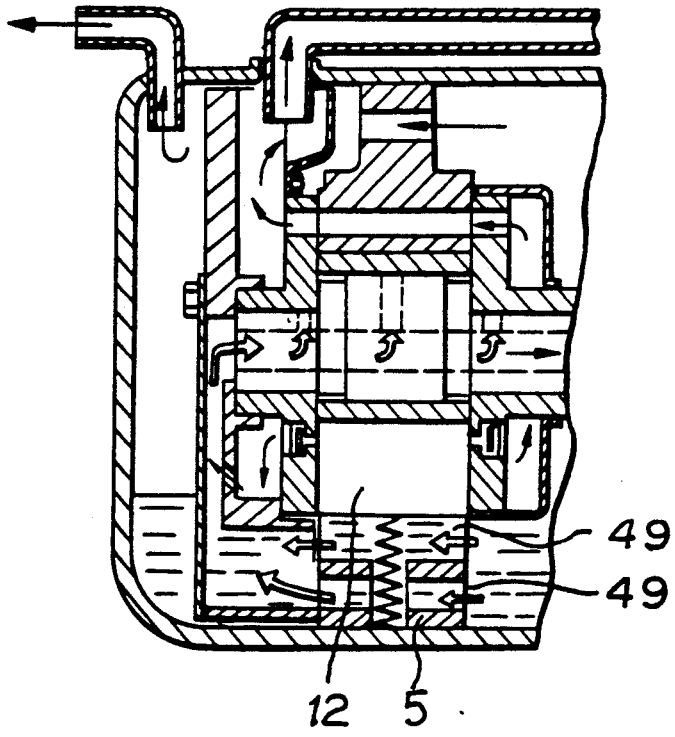
FIG. 16 is an axial sectional view in part of a sixth embodiment of the horizontal rotary compressor.

Referring now to FIG. 16, there is shown a sixth embodiment of the present invention. In the sixth embodiment, a cylinder 5 has two through passages 49 and 49 arranged behind a vane 12. Such arrangement can further improve the lubricating oil feeding effect offered by the pressure acting behind the vane 12.

Figure 17:
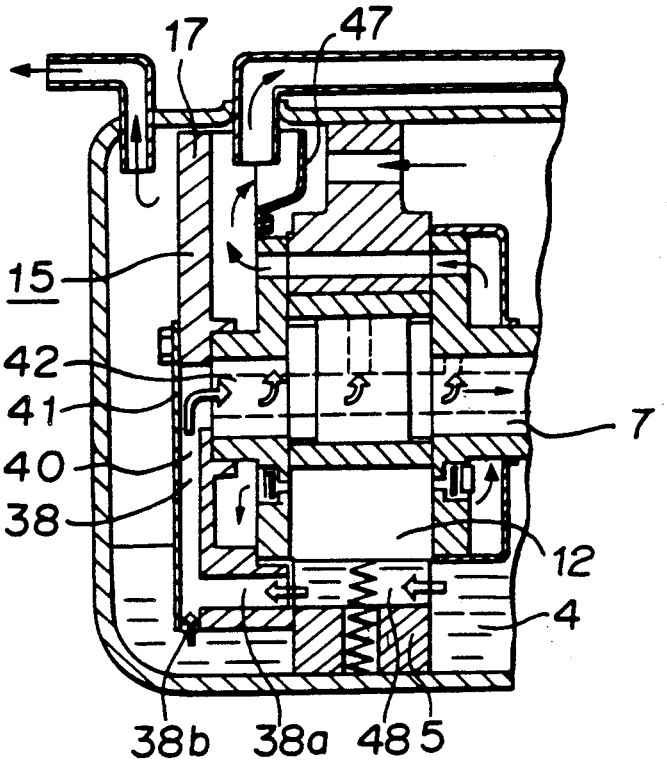
FIG. 17 is an axial sectional view in part of a seventh embodiment of the horizontal rotary compressor.

Referring now to FIG. 17, there is shown the horizontal rotary compressor according to a seventh embodiment of the present invention. FIG. 17 is a fragmentarily axial sectional view showing the essential parts of the horizontal rotary compressor. A discharge muffler 15 includes a projection 17 whose half part 47 is made of sheet metal, and lubricating oil passage 38. The lubricating oil passage 38 has one end opened at a through passage 48 behind a vane 12 in a cylinder 5, and at a location in a lubricating oil 4. The lubricating oil passage 38 has the other end opened at a lubricating oil feeding hole 42 which is formed in a crankshaft 7.

Figure 18:
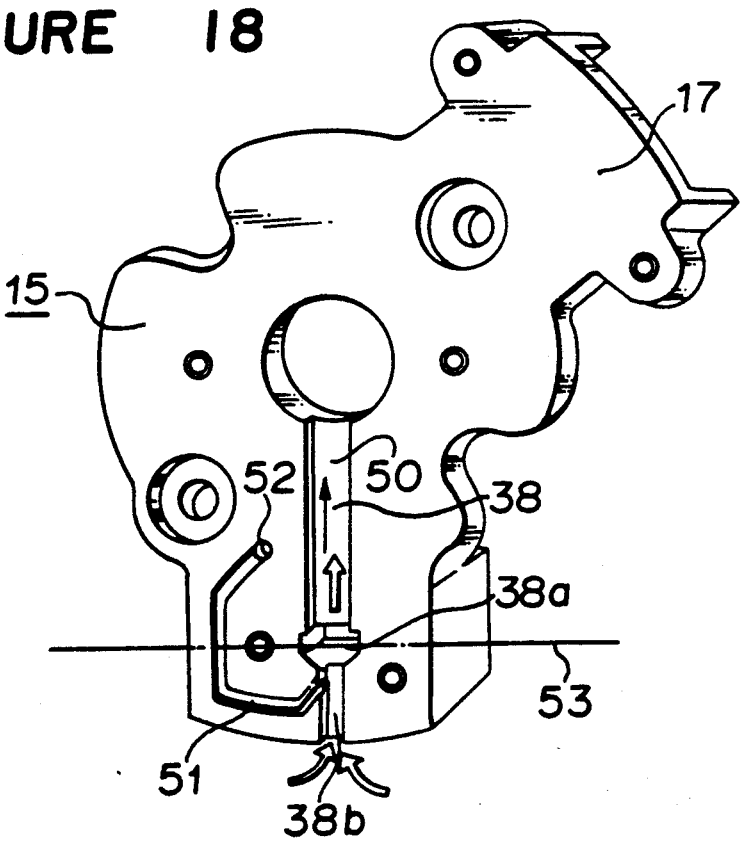
FIG. 18 is a perspective view showing a lubricating oil pump which is incorporated in the horizontal rotary compressor of FIG. 17.

The discharge muffler 15 of the seventh embodiment is shown as a perspective view in FIG. 18. As shown in FIG. 18, the discharge muffler includes the projection 17 and a recessed portion 50 formed in the main body of the discharge muffler like the one shown in FIG. 15. A cover (not shown) and the recessed portion 50 form the lubricating oil passage 38. In addition, the discharge muffler 15 is provided with a refrigerant passage 51 and a refrigerant inlet hole 52. The refrigerant passage 51 is constituted by a recessed portion formed in the discharge muffler main body, and the cover (not shown). The refrigerant passage 51 communicates with the lubricating oil passage 38 below the surface of the lubricating oil 4 or in the vicinity of the lubricating oil surface so as to extend in an upwardly slanted direction. In FIG. 18, a dotted line 53 indicates the surface of the lubricating oil. The refrigerant inlet hole 52 is formed in the discharge muffler main body so as to connect between the space in the discharge muffler 15 and the refrigerant passage 51.

Because the lubricating oil pump according to the seventh embodiment is constructed as stated above, part of the refrigerant gas which has discharged from discharge ports 32 and 33 flows from the space in the discharge muffler 15 into the refrigerant passage 51 through the refrigerant inlet hole 52, and energetically flows out toward the lubricating oil passage 38 at a location below the lubricating oil surface 53. Then that part of the refrigerant gas moves along the lubricating oil passage 38, and reaches the end of the crankshaft 7. When the discharged refrigerant gas flows out from the refrigerant passage 51 into the lubricating oil passage 38, the discharged refrigerant gas energetically spouts out into the lubricating oil passage 38 in the lubricating oil. The energy of the refrigerant gas at that time is utilized to suck the lubricating oil up to the end of the crankshaft 7. The lubricating oil is subjected to such force that it is pushed up in the lubricating oil passage 38. Suppose that the connection between the refrigerant passage 51 and the lubricating oil passage 38 is made far above the lubricating oil surface 53. Even if the refrigerant gas energetically spouts out from the refrigerant passage 51 into the lubricating oil passage 38 in that case, the lubricant oil is subjected to only such suction action that it is sucked into the lubricating oil passage 38. Comparing such suction action with the push-up-action stated earlier, pushing the lubricating oil up is found to be more effected in order to sufficiently supply the lubricating oil to the end of the crankshaft 7. In order to cope with the case wherein the lubricating oil surface temporarily lowers from an ordinary level under some operating conditions of the compressor, it is preferable that the connection between the refrigerant passage 51 and the lubricating oil passage 38 is made at as low a location as possible to obtain enough pumping action.

In addition, there are provided two passages **38*a* and 38*b* for supplying the lubricating oil to the lubricating oil passage 38, the one 38*a* utilizing the pressure behind the vane 12, and the other 38*b* utilizing the ejection effect by the discharged refrigerant gas. As a result, when the lubricating oil surface lies below the passage 38*a* utilizing the pressure behind the vane 12, the lubricating oil can be sucked through the other passage 38*b*. Even if the lubricating oil surface temporarily lowers at the time of starting the compressor or under some operating conditions, oil-feeding can be carried out without failure. The lubricating oil can pass through the passage 38*b* not only when the lubricating oil surfaces lowers below the passage 38*a* but also when the lubricating oil surface lies above the passage 38*a*** under normal operating conditions of the compressor. The provision of the two passages allows the oil feeding action to be carried out more effectively.

In FIG. 17, arrows (←) in black indicates the flow of the refrigerant gas, and arrows (⇐) in white indicates the flow of the lubricating oil.

Figure 19:
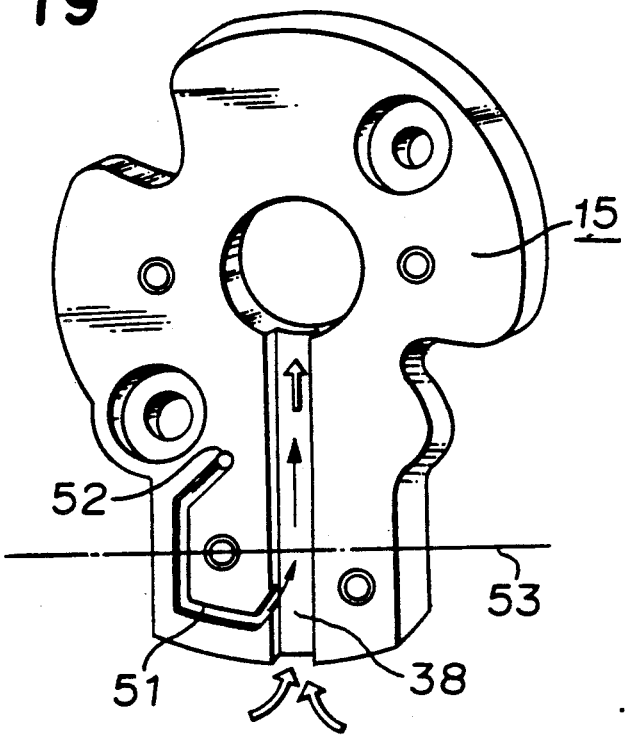
FIG. 19 is a perspective view showing an eighth embodiment of the lubricating oil pump.
Figure 20:
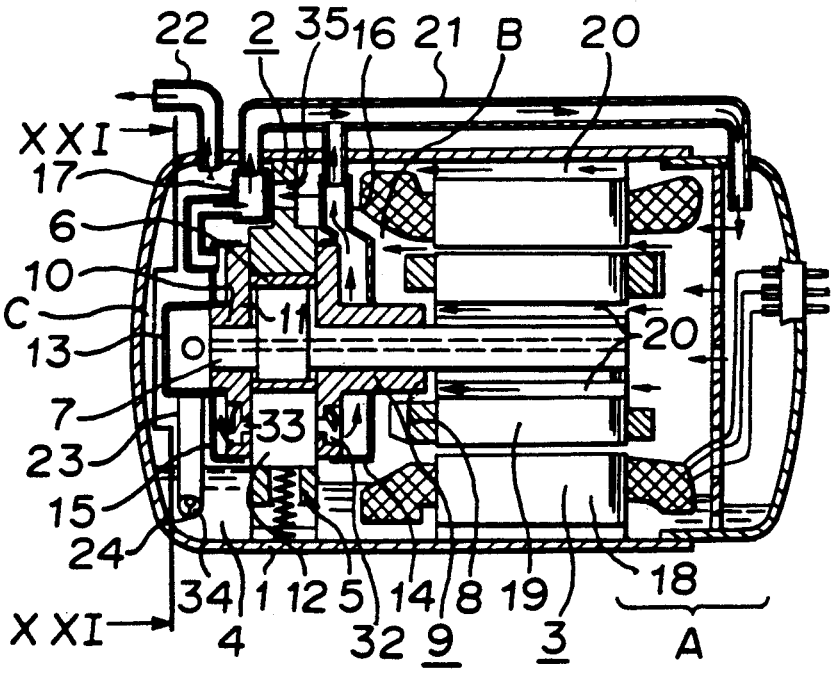
FIGURE 20 (RELATED ART)
FIG. 20 is an axial sectional view showing a conventional horizontal rotary compressor.
Figure 21:
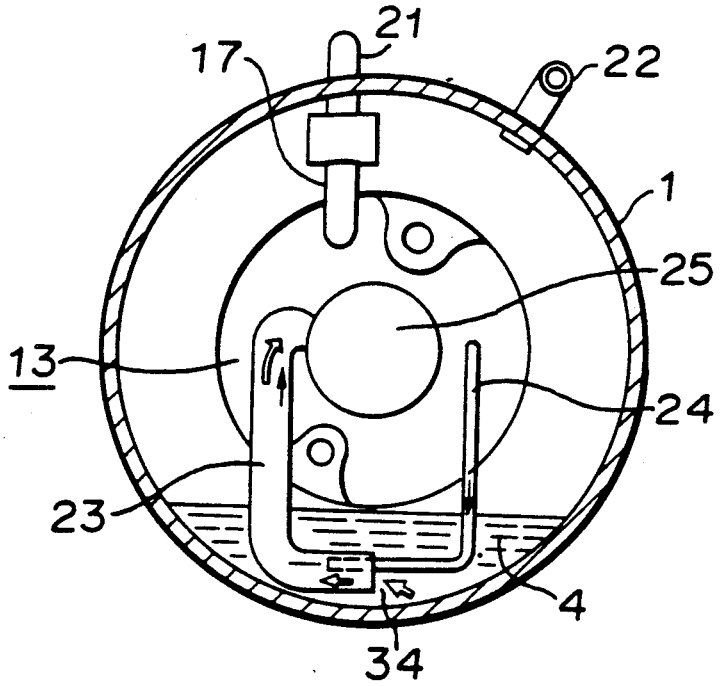
FIGURE 21 (RELATED ART)
FIG. 21 is a sectional view taken along the line XXI—XXI of FIG. 20.
Figure 22:
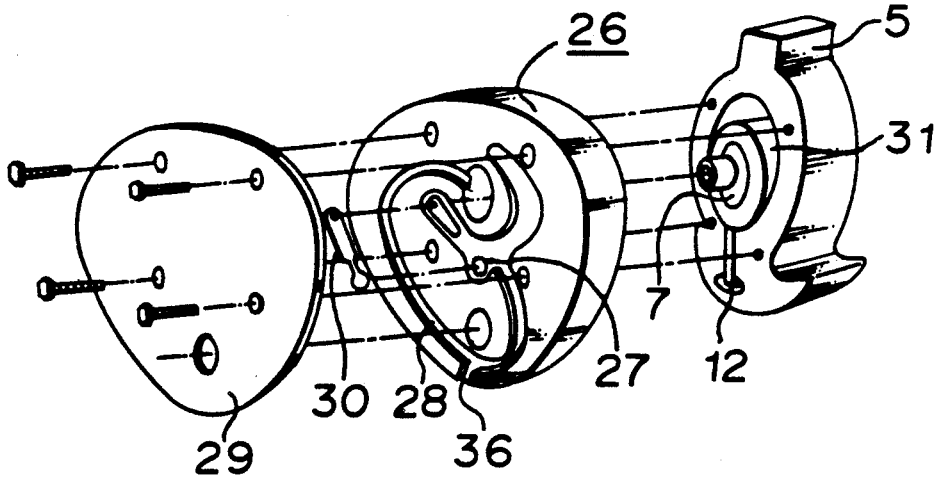
FIGURE 22 (RELATED ART)
FIG. 22 is a perspective view showing a conventional lubricating oil pump in a disassembled manner.

Referring now to FIG. 19, there is shown the discharge muffler 15 according to an eighth embodiment of the present invention. FIG. 19 is a perspective view showing the discharge muffler 15. The discharge muffler is formed with a lubricating oil passage 38 and a refrigerant passage 51 which communicates with the lubricating oil passage 38 in an upwardly slanted position. The refrigerant passage 51 communicates with the space in the discharge muffler 15 through a refrigerant inlet hole 52. The lubricating oil passage 38 and the refrigerant passage 51 have complete forms by attaching a cover (not shown) to the discharge muffler 15. In FIG. 19, a dotted line 53 indicates the surface of the lubricating oil. The lubricating oil pump of the eighth embodiment can feed the lubricating oil to the end of a crankshaft 7 by use of push-up-action like the seventh embodiment to sufficiently supply the lubricating oil to parts constituting a compression unit. Even if the lubricating oil surface has temporarily lain below the connection between the lubricating oil passage 38 and the refrigerant passage 51 under some operating conditions of the compressor or at the time of starting the compressor, the lubricating oil can be carried to the end of the crankshaft 7 as the suction action of the lubricating oil. As a result, a highly reliable compressor can be produced at a low cost.

Obviously, numerous modifications and variations of the present invention are possible in light of the above teachings. It is therefore to be understood that within the scope of the appended claims, the invention may be practiced otherwise than as specifically described herein.

What is claimed is:

1. A horizontal rotary compressor comprising:

a sealed shell having a lubricating oil accumulated at a lower part therein;

a drive unit included in the sealed shell;

a compression unit included in the sealed shell and driven by the drive unit through a crankshaft;

the crankshaft having a lubricating oil feeding hole formed therein;

a lubricating oil pump for supplying the lubricating oil to the crankshaft to lubricate the compression unit;

a discharge muffler which is arranged at the end of the compression unit remote from the drive unit, and which is provided with a lubricating oil passage;

the lubricating oil passage having one end opened in the lubricating oil and the other end opened at the lubricating oil feeding hole;

a discharge refrigerant gas passage formed in the discharge muffler so as to communicate a space in the discharge muffler with the lubricating oil passage, said discharge refrigerant gas passage being inclined upwardly toward said oil feeding hole at a point of intersection between said discharge refrigerant gas passage and said lubricating oil feeding passage; and an other refrigerant gas passage through which said refrigerant gas can exit from said space without entering said lubricating oil passage.

2. A horizontal rotary compressor comprising:

a sealed shell having a lubricating oil accumulated at a lower part therein;

a drive unit included in the sealed shell;

a compression unit included in the sealed shell, driven by the drive unit through a crankshaft, and having a cylinder;

the crankshaft having a lubricating oil feeding hole formed therein;

the cylinder having a vane arranged therein for compressing a refrigerant gas;

a lubricating oil pump for supplying the lubricating oil to the crankshaft to lubricate the compression unit;

at least one through passage which is formed in the cylinder at a location behind the vane;

a discharge muffler which is arranged at the end of the compression unit remote from the drive unit, and which is provided with a lubricating oil passage;

the lubricating oil passage having one end opened at the through passage behind the vane and the other end opening at the lubricating oil feeding hole; and a discharge refrigerant gas passage formed in the discharge muffler so as to communicate a space in the discharge muffler with the lubricating oil feeding passage, said discharge refrigerant gas passage being inclined upwardly toward said oil feeding hole at a point of intersection between said discharge refrigerant gas passage and said lubricating oil feeding passage.

3. A horizontal rotary compressor according to claim 2, wherein the one end of the discharge muffler also opens in the lubricating oil, and wherein the connection between the discharge refrigerant gas passage and the lubricating oil feeding passage is made below the lubricating oil surface.

4. A horizontal rotary compressor according to claim 1, wherein the connection between the discharge refrigerant gas passage and the lubricating oil feeding passage is made below the lubricating oil surface.

* * * * *